US008162240B2

(12) United States Patent
Bondi

(10) Patent No.: US 8,162,240 B2
(45) Date of Patent: Apr. 24, 2012

(54) ACTOR DEVICE FOR AN INJECTOR AND INJECTOR

(75) Inventor: Antonio Bondi, Rosia (IT)

(73) Assignee: Continental Automotive GmbH, Hannover (DE)

( * ) Notice: Subject to any disclaimer, the term of this patent is extended or adjusted under 35 U.S.C. 154(b) by 547 days.

(21) Appl. No.: 11/670,798

(22) Filed: Feb. 2, 2007

(65) Prior Publication Data

US 2007/0241213 A1 Oct. 18, 2007

(30) Foreign Application Priority Data

Feb. 3, 2006 (EP) ..... 06002242

(51) Int. Cl.
*B05B 1/30* (2006.01)

(52) U.S. Cl. ..... 239/584; 239/585.3

(58) Field of Classification Search ..... 239/584, 239/585.1, 585.3, 585.4, 585.5, 533.2, 533.9, 239/102.1; 251/129.15, 129.21, 127; 29/890.124, 29/890.127

See application file for complete search history.

(56) References Cited

U.S. PATENT DOCUMENTS

| | | | | |
|---|---|---|---|---|
| 4,579,283 | A * | 4/1986 | Igashira et al. | 239/88 |
| 6,313,568 | B1 * | 11/2001 | Sullivan et al. | 310/346 |
| 6,637,677 | B1 * | 10/2003 | Ruehle et al. | 239/584 |
| 6,948,667 | B2 * | 9/2005 | Eichendorf | 239/585.1 |
| 2006/0043213 | A1 | 3/2006 | Gerschwitz et al. | 239/102.2 |
| 2006/0131113 | A1 | 6/2006 | Christof et al. | 188/72.1 |

FOREIGN PATENT DOCUMENTS

| | | | |
|---|---|---|---|
| DE | 103 10 499 | A1 | 9/2004 |
| EP | 1 431 568 | A2 | 6/2004 |
| EP | 1 482 569 | A1 | 12/2004 |
| EP | 1 553 286 | A1 | 7/2005 |
| WO | 2004/046543 | A1 | 6/2004 |

* cited by examiner

*Primary Examiner* — Davis Hwu
(74) *Attorney, Agent, or Firm* — King & Spalding L.L.P.

(57) ABSTRACT

An actor device (14) for an injector has a solid-state actuator (17) and a first and a second end plate (18, 16) which are coupled to the solid-state actuator (17) at first and, respectively, at second axial end of the solid-state actuator (17). Further, the actor device (14) has a sliding body (24) which is rigidly coupled to the first end plate (18) and which extends to the second end plate (16). The sliding body (24) radially surrounds the solid-state actuator (17) and has a clearance to the solid-state actuator (17) and to the second end plate (16).

14 Claims, 2 Drawing Sheets

ACTOR DEVICE FOR AN INJECTOR AND INJECTOR

RELATED APPLICATION

This application claims priority from European Patent Application No. EP06002242, which was filed on Feb. 3, 2006, and is incorporated herein by reference in its entirety.

TECHNICAL FIELD

The invention relates to an actor device for an injector and the injector. The actor device comprises a solid-state actuator. Further, the actor device comprises a first and a second end plate. The first and the second end plate are coupled to the solid-state actuator at a first and, respectively, at a second axial end of the solid-state actuator.

BACKGROUND

WO 2004/046543 A1 discloses a guide piece in a drilling in a housing, in which a further moving component is arranged fixed to the guide piece and an injector for fuel injection. The guide piece comprises a slide ring on the periphery thereof, which compensates for the gap between the guide piece and the wall of the drilling, such that the further component runs centrally during the axial displacement thereof. The glide ring permits the advantages of a reduction in friction on the wall of the drilling and is of application thereby for construction reasons, no lubrication for the slide surfaces is possible. The above occurs for example in an injector for fuel injection in which a piezo electric actuator must be precisely guided in the drilling, in order to effectively transmit the minimal length change thereof to the nozzle needle.

SUMMARY

The object of the invention is to create an injector and an actor device for the injector which enable a precise function of a solid-state actuator of the actor device.

The object can be achieved by an actor device for an injector comprising a solid-state actuator, a first and a second end plate which are coupled to the solid-state actuator at a first and at a second axial end of the solid-state actuator, respectively, and a sliding body which is rigidly coupled to the first end plate, which extends to the second end plate, and which has a clearance to the solid-state actuator and to the second end plate.

According to an embodiment, the sliding body and the first end plate may be rigidly coupled to each other at an end face of the first end plate and at an end face of the sliding body. According to an embodiment, the sliding body can be tube-shaped.

The object can also be achieved by an injector for dosing fluid comprising a housing, an actor device comprising a solid-state actuator, a first and a second end plate which are coupled to the solid-state actuator at a first and at a second axial end of the solid-state actuator, respectively, and a sliding body which is rigidly coupled to the first end plate, which extends to the second end plate, and which has a clearance to the solid-state actuator and to the second end plate wherein the actor device is arranged in the housing movable in axial direction, and a needle which is arranged in the housing movable in axial direction and which is coupled to the actor device and which prevents in a closed position of the needle a fluid flow through an injection nozzle in the housing and otherwise enables the fluid flow through the injection nozzle.

According to an embodiment, the injector may have a slight clearance between the sliding body and the housing. According to an embodiment.

BRIEF DESCRIPTION OF THE DRAWINGS

Advantageous embodiments of the invention are explained in the following with the help of schematic drawings. These are as follows.

Elements with the same design and function that appear in the different illustrations are identified by the same reference characters.

DETAILED DESCRIPTION

The invention is distinguished by an actor device for an injector. According to an embodiment, the actor device may comprise a solid-state actuator. Further, according to an embodiment, the actor device may comprise a first and a second end plate. The first and the second end plate can be coupled to the solid-state actuator at a first and, respectively, at a second axial end of the solid-state actuator. Further, the actor device may comprises a sliding body. The sliding body can be rigidly coupled to the first end plate. The sliding body may extend to the second end plate and radially surrounds the solid-state actuator. The sliding body may have a clearance to the solid-state actuator and to the second end plate.

The sliding body enables a proper guiding of the solid-state actuator in a housing of the injector. The proper guiding relates to a precise movement of the actor device and to less friction between the actor device and the housing of the injector.

According to an embodiment of the actor device, the sliding body and the first end plate can be rigidly coupled to each other at an end face of the first end plate and at an end face of the sliding body. This contributes to avoid friction between the actor device and the housing because of the rigid coupling.

In a further embodiment of the actor device, the sliding body can be tube-shaped. This contributes to a proper stability of the sliding body.

Furthermore, according to an embodiment, the invention is distinguished by an injector comprising the actor device. The injector can be suitable for dosing fluid. The injector may comprise a housing. The actor device can be arranged in the housing moveable in axial direction. Furthermore, according to an embodiment, the injector may comprise a needle which is arranged in the housing moveable in axial direction. The needle can be coupled to the actor device and prevents in a closed position of the needle a fluid flow through an injection nozzle in the housing and otherwise enables the fluid flow through the injection nozzle.

In an embodiment of the injector, the injector has a slight clearance between the sliding body and the housing. This contributes to the proper guiding of the actor device in the housing.

Figure 1:
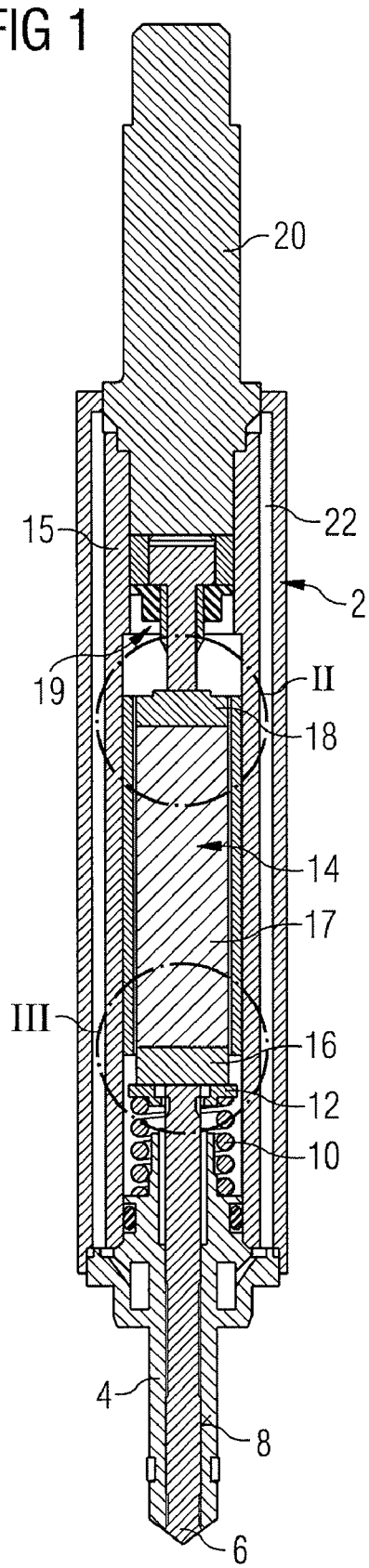
FIG. 1 an injector.

An injector (FIG. 1) comprises an injector housing 2, a nozzle body 4 having a nozzle body recess 6, a needle 8, a spring 10, and a spring washer 12. The needle 8 is arranged movable in axial direction in the nozzle body recess 6. The spring 10 is arranged circumferential the needle 8 and in axial direction intermediate the nozzle body 4 and the spring washer 12. The spring 10 acts on the needle 8 via the spring washer 12 in direction away from the nozzle body 4. The injector is preferably suited for injecting fluid, which is in this embodiment preferably fuel, into a combustion chamber of an internal combustion engine. In an alternative embodiment, the nozzle body 4 may be made of two or more pieces.

Figure 2:
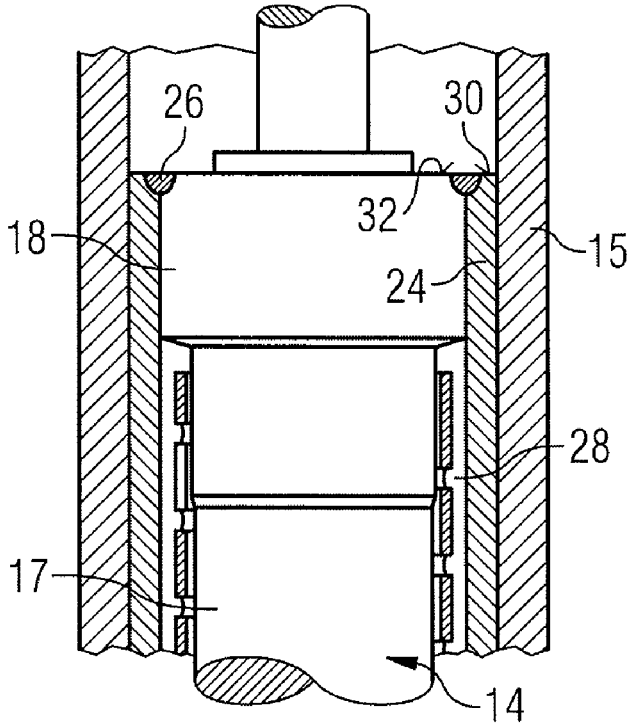
FIG. 2 a first detailed view of the injector according to FIG. 1.
Figure 3:
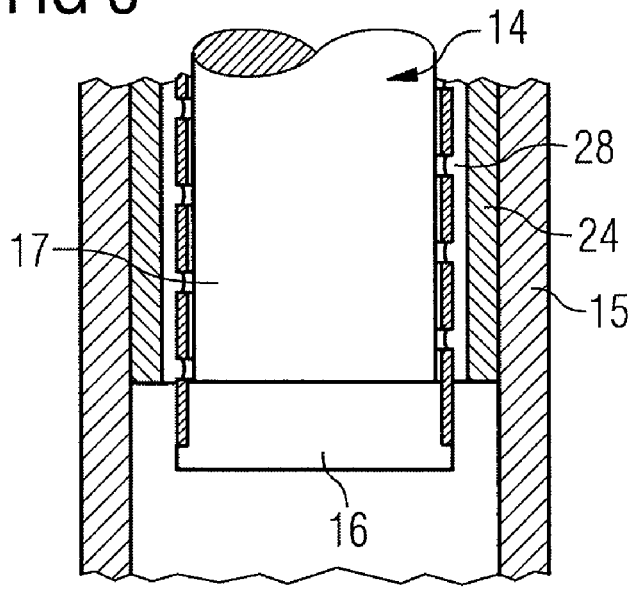
FIG. 3 a second detailed view of the injector according to FIG. 1.

An actor device 14 is arranged in an inner tube 15 of the injector housing 2. The actor device 14 comprises a ground plate 16 , a solid-state actuator 17 and a top plate 18. Further, the actor device 14 comprises a sliding body 24 (FIG. 2, FIG. 3). Preferably, the sliding body is tube-shaped and surrounds the actuator 17 in radial direction. This contributes to a proper stability of the sliding body. The actor device 14 is arranged intermediate the spring washer 12 and a compensation assembly 19. The solid-state actuator 17 acts on the needle 8 and on the spring washer 12 via the ground plate 16. The solid-state actuator 17 acts on the compensation assembly 19 via the top plate 18. In an alternative embodiment, the compensation assembly 19 may be arranged intermediate the actor 14 and the spring washer 12 and the needle 8 .

The fluid may flow from a connection 20 to the nozzle body 4 through a free volume between the inner tube 15 and the injector housing 2.

In a closed position of the needle 8, the needle 8 and the nozzle body 4 prevent a fluid flow into the combustion chamber of the internal combustion engine. Outside of the closed position of the needle 8, there is a nozzle formed between a tip of the needle 8 and a tip of the nozzle body 4 facing away from the actor 14. Whether the needle 8 is in its closed position or not depends on a force balance between a first force acting on the needle 8 because of the spring 10 and a second force acting on the needle 8 because of the solid-state actuator 17. The solid-state actuator 17 preferably is a piezoelectric actuator.

If the solid-state actuator 17 gets energized, it expands its axial length. If the solid-state actuator 17 gets de-energized, the axial length decreases.

If the temperature of the injector increases while the operation of the injector, the injector, especially the injector housing 2, expands its axial length. In general, the injector housing 2, which is preferably made of stainless steel, expands more with the temperature than the actor 14. The compensation assembly 19 is arranged in order to compensate the thermal expansion of the injector housing 2.

The sliding body 24 is rigidly coupled to the first end plate 18 of the actor device 14 at an end face 30 of the sliding body 24 and at an end face 32 of the end plate 18 of the actor device 14. A rigid coupling 26 preferably is made by welding. The rigid coupling 26 at the end faces 30, 32 contributes to avoid friction between the actor device 14 and the housing 2 of the injector. There is a clearance 28 between the solid-state actuator 17 and the sliding body 24 in radial direction. The sliding body 24 extends in axial direction to the second end plate 16 alternatively. The sliding body 24 may further extend in axial direction towards the needle 8. If there is an axially extending overlapping area between the sliding body 24 and the second end plate 16, then there is the clearance 28 between the sliding body 24 and the end plate 16.

If the solid-state actuator 17 gets energized it changes its axial length. Further, the whole solid-state actuator 17 bends itself in such a way that the clearance 28 between the solid-state actuator 17 and between the sliding body 24 and the end plate 16 decreases at one side of the solid-state actuator 17 and increases at the opposite side of the solid-state actuator 17. The clearance 28 enables the bending of the solid-state actuator 17 and in that way enables a free expansion of the solid-state actuator 17. Because of that, there is no friction between the solid-state actuator 17 and the sliding body 24. This enables a proper steering of the solid-state actuator 17 and contributes to a precise dosing of fluid by the injector.

The sliding body 24 is formed in such a way that there is a slight clearance between the sliding body 24 and the tube 15 of the housing 2. Preferably, the clearance is formed in such a way, that the sliding body 24 may move in axial direction in the tube 15 of the housing 2 while having a proper guidance of the sliding body 24 by the inner tube 15 of the housing 2. If the housing 2 and, in particular, the tube 15 expand with an increase of temperature of the injector and/or if the solid-state actuator 17 gets energized or de-energized, the sliding body 24 and the inner tube 15 of the housing 2 move relative to each other. The sliding body 24 contributes to less friction by this movement. So, the sliding body 24 contributes to a proper guiding of the solid-state actuator 17 in the inner tube 15 of the housing 2 and in that way to a precise dosing of fluid by the injector. The sliding body 24 preferably is made of stainless steel.

The invention is not restricted on the explained embodiment. For example, the sliding body 24 may comprise recesses at a shell of the sliding body 24 and/or the sliding body may comprise columns which extend from the first to the second end plate 18, 16. This contributes to a light sliding body 24. The lighter the sliding body 24 is, the less mass the actuator 17 has to move, and the more precise is the function of the actor device 14. Further, the columns may contribute to reduce the friction between the sliding body 24 and the inner tube 15 of the housing 2. The light sliding body 24 and the reduced friction contribute to a proper and precise function of the actor device 14 and so to a precise dosing of fluid by the injector.

What is claimed is:

1. An actor device for an injector comprising an injector housing, a solid-state actuator having an outer perimeter and an axial length extending from a first axial end to a second axial end opposite the first axial end, a first end plate located at and coupled to the first axial end of the solid-state actuator, a second end plate located at and coupled to the second axial end of the solid-state actuator, a rigid sliding body which is rigidly coupled to the first end plate at the first axial end of the solid-state actuator, wherein the rigid sliding body is located outside the outer perimeter of the actuator and extends along a substantial portion of the axial length of the actuator, and which has a clearance to the solid-state actuator and to the second end plate, and a temperature compensation assembly coupled to the actor device such that the temperature compensation assembly and actuator are axially positioned on opposite sides of the first end plate, wherein the temperature compensation assembly compensates for different thermal expansions of the actor device and a housing containing the actor device;

wherein the first end plate, the first axial end of the solid-state actuator, the second end plate, and the second axial end of the solid-state actuator are all axially movable relative to the injector housing.

2. The actor device according to claim 1, wherein the sliding body and the first end plate being rigidly coupled to each other at an end face of the first end plate and at an end face of the sliding body.

3. The actor device according to claim 1, wherein the sliding body being tube-shaped.

4. The actor device according to claim 1, wherein the temperature compensation assembly is coupled at the first end plate.

5. The actor device according to claim 1, wherein the temperature compensation assembly is coupled at the second end plate.

6. An injector for dosing fluid comprising a housing, an actor device comprising a solid-state actuator having an outer perimeter and an axial length extending from a first axial end to a second axial end opposite the first axial end, a first end plate located at and coupled to the first axial end of the solid-state actuator, a second end plate located at and coupled to the second axial end of the solid-state actuator, and a rigid sliding body (a) which is rigidly coupled to the first end plate at the first axial end of the solid-state actuator, wherein the rigid sliding body is located outside the outer perimeter of the actuator and extends along a substantial portion of the axial length of the actuator, and which has a clearance to the solid-state actuator and to the second end plate, wherein the actor device is arranged in the housing movable in an axial direction, a needle which is arranged in the housing movable in axial direction and which is coupled to the actor device and which prevents in a closed position of the needle a fluid flow through an injection nozzle in the housing and otherwise enables the fluid flow through the injection nozzle, and a temperature compensation assembly coupled between the housing and the actor device such that the temperature compensation assembly and actuator are axially positioned on opposite sides of the first end plate, wherein the temperature compensation assembly compensates for different thermal expansions of the housing and the actor device;

wherein the first end plate, the first axial end of the solid-state actuator, the second end plate, and the second axial end of the solid-state actuator are all axially movable relative to the injector housing.

7. The injector according to claim 6 having a slight clearance between the sliding body and the housing.

8. The injector according to claim 6, wherein the temperature compensation assembly is coupled at the first end plate.

9. The injector according to claim 6, wherein the temperature compensation assembly is coupled at the second end plate.

10. An method for manufacturing an actor device for an injector comprising:

providing an injector housing, providing a solid-state actuator having an outer perimeter and an axial length extending from a first axial end to a second axial end opposite the first axial end, coupling a first end plate to the first axial end of the solid-state actuator and coupling a second end plate to the second axial end of the solid-state actuator such that the full axial length of the actuator is located between the first and second end plates, and coupling a rigid sliding body rigidly to the first end plate at the first axial end of the solid-state actuator, wherein the rigid sliding body is located outside the outer perimeter of the actuator and extends along a substantial portion of the axial length of the actuator, and which has a clearance to the solid-state actuator and to the second end plate, and providing a temperature compensation assembly coupled to the actor device such that the temperature compensation assembly and actuator are axially positioned on opposite sides of the first end plate, wherein the temperature compensation assembly compensates for different thermal expansions of the actor device and a housing containing the actor device;

wherein the first end plate, the first axial end of the solid-state actuator, the second end plate, and the second axial end of the solid-state actuator are all axially movable relative to the injector housing.

11. The method according to claim 10, further comprising the step of rigidly coupling the sliding body and the first end plate to each other at an end face of the first end plate and at an end face of the sliding body.

12. The method according to claim 10, wherein the sliding body being tube-shaped.

13. The method according to claim 10, wherein the temperature compensation assembly is coupled at the first end plate.

14. The method according to claim 10, wherein the temperature compensation assembly is coupled at the second end plate.

* * * * *